United States Patent [19]

Steidinger

[11] Patent Number: 5,064,115

[45] Date of Patent: Nov. 12, 1991

[54] MAILER AND METHOD AND APPARATUS FOR MAKING

[75] Inventor: Donald J. Steidinger, Barrington, Ill.

[73] Assignee: Wallace Computer Services, Inc., Hillside, Ill.

[21] Appl. No.: 563,404

[22] Filed: Aug. 6, 1990

[51] Int. Cl.[5] ..... B65D 27/04; B65D 27/06

[52] U.S. Cl. ..... 229/304; 229/71

[58] Field of Search ..... 229/71, 73, 92, 92.1, 229/92.3

[56] References Cited

U.S. PATENT DOCUMENTS

| | | | |
|---|---|---|---|
| 3,652,007 | 3/1972 | MacDougall | 229/73 |
| 4,305,506 | 12/1981 | Greenwald | 229/73 X |
| 4,380,315 | 4/1983 | Steidinger | 206/610 X |
| 4,411,643 | 10/1983 | Higginson | 229/73 X |
| 4,437,852 | 3/1984 | Volk et al. | 229/73 X |
| 4,524,903 | 6/1985 | Vath | 229/73 |
| 4,625,909 | 12/1986 | Ferrando | 229/92.1 |
| 4,651,920 | 3/1987 | Stenner | 229/73 X |
| 4,706,878 | 11/1987 | Lubotta et al. | 229/73 |
| 4,754,915 | 7/1988 | Steidinger | 229/73 X |
| 4,778,101 | 10/1988 | Paguin | 229/73 |
| 4,889,278 | 12/1989 | Steidinger | 229/73 X |
| 4,960,237 | 10/1990 | Bendel | 229/73 |

*Primary Examiner*—Stephen Marcus
*Assistant Examiner*—Jes F. Pascua
*Attorney, Agent, or Firm*—Tilton, Fallon, Lungmus & Chestnut

[57] ABSTRACT

A mailer product and apparatus and method in which a first sheet is printed by a computer printer and then augmented by a second sheet prior to entering folding means, one of the sheets being twice transversely folded.

10 Claims, 8 Drawing Sheets

MAILER AND METHOD AND APPARATUS FOR MAKING

BACKGROUND AND SUMMARY OF INVENTION

This invention relates to a mailer and method and apparatus for making and, more particularly, to a mailer production utilizing two sheets which are superposed prior to being folded.

The invention is particularly useful in connection with a non-impact printed sheet (such as those printed by laser, ink jet, etc.) and which can be seen in greater detail in my patent Nos. 4,754,915 and 4,889,278.

The mailer made possible by the invention is advantageous in combining a computer printed form with one or more additional sheets such as a return envelope, insert, label, coupon or an outer envelope.

After processing the computer printed form on the computer for business systems information, personalization or simply addressing, the form is folded and glued on a commercial folder. According to the invention, the method provides the step of adding additional material to the mailing piece immediately before folding or directly into the nip of the folding rollers or other folding mechanism.

The computer generated form can be a simple, single ply without attachments during the computer printing operation which is particularly desirable when using laser printers. It is then possible to include additional materials in the finished mailer that would not be possible if they were added before computer printing due to the limitations of the printers.

The development of the laser printers for computer printout has provided new capabilities that are desired in business and promotional graphic systems.

The much higher speed capability of the laser printer continues the progress for ever faster printout capabilities needed to match the faster computers. Other desired capabilities of laser printers are the ability to printout in an infinite number of type sizes and styles including MICR, optical characters, bar codes, and even pictures. These special features make the future of laser printing very bright for both high speed systems and smaller slower speed but still versatile computer printers for smaller business systems.

These highly desirable features are accompanied by limitations uncharacteristic of previous computer systems. The laser printer is non-impact, thus eliminating carbon copies, carbonless imaging and multiple copies in general. The higher transport speeds of the business form in the computer complicate feeding and refolding problems which have traditionally been troublesome. The heating of the web required to fuse the image causes distortions and permanent changes to the paper which have caused feeding, refolding, and stacking problems. Finally, the laser printer tends to be envisioned as a single ply printer and requires a level surface of uniform thickness in the imaging area if high quality is to be achieved.

The requirements of business and promotional forms are at odds with these limitations. Although these systems are enhanced by the advantages of laser printers, they are also enhanced by features such as additional plies, return envelopes, folded over portions, attachments such as labels, coupons, etc.

It is the purpose of this invention to provide for these additional requirements without complicating the form to be processed on the computer printer.

There are many large and important business and promotional systems that can be met satisfactorily with a mailer using a single ply of computer printer, for instance, the issuing of checks for savings, mutual funds, and corporate dividend payments. Often these checks do not require more information to accompany them than can be provided in a single ply mailer. These requirements can be met by the mailers of my inventions 4,754,915 and 4,889,278. But it is also a common need even in relatively simple business systems to include additional sheets of information when some unexpected notice is required. In these cases, it is inconvenient, expensive, and even impractical due to time limitations to go back to the forms printer for a run of special forms.

In other systems, it is always advantageous to provide a return envelope, a label or such that is not practical to be attached to the form as it is being laser printed.

This invention concerns the folding of mailers from laser printed blanks which also has provision for adding inserts, labels, coupons, return envelopes, outgoing envelopes and the like to the single ply computer generated form before or during the folding operation. The added pieces could be in the form of individual cut pieces or from rolls or packs of continuous forms. For instance, it may be more convenient to feed return envelopes as individual pieces but pressure sensitive labels, notices, coupons and such from a continuous series supplied in rolls or fanfolded packs.

It may also be advantageous to add some of these items before the first folding operation. In this case, these items can be held by glue or other fastenings such as static electricity, crimping, or stapling or they may be friction fed along with the laser printed blanks.

In still other cases, it may be advantageous to feed the additional item directly into the folding rollers thereby achieving accurate positioning of the item on the mailing piece without requiring any fastening.

It is another purpose of this invention to provide a mailer through a method and an apparatus of adding the above-mentioned items with much less restrictions on their design and construction than would be required if the items were to be transported through the laser printer during the printing operation. The method includes providing at least two series of sheets in juxtaposed relation and introducing the forward end of at least one sheet of one series into folding means and thereafter folding one or both sheets along parallel lines. The apparatus includes a computer printer, rotating rolls defining sequential nips therebetween, buckle folder chutes between the nips, and means for feeding a pair of superposed sheets sequentially through the nips and chutes, one of the sheets being generated by the computer printer. This results in a mailer assembly including a relatively elongated outer ply having at least two transverse folds each providing a fold pocket, and an insert ply positioned in the fold pockets and extending therebetween.

BRIEF DESCRIPTION OF THE DRAWINGS

The invention is explained in conjunction with the accompanying drawing, in which.

DETAILED DESCRIPTION

Figure 1:
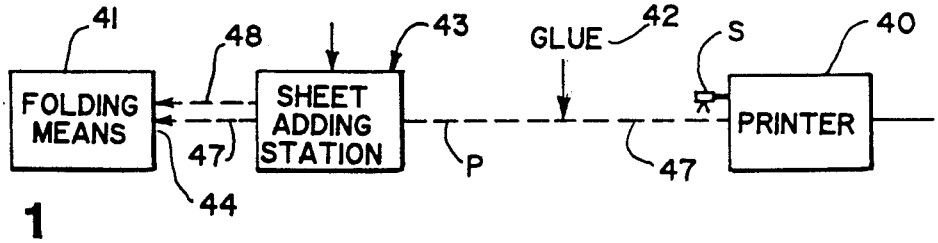
FIG. 1 is a schematic diagram of one embodiment of the method and apparatus for practicing the invention.

Referring first to FIG. 1, the numeral 40 generally designates a computer printer, preferably a non-impact type of printer which could be laser, ink jet, etc. As indicated previously, these are becoming increasingly popular for printing on single sheets at high speed. Such printers can print on either individual sheets or continuous webs, depending upon the type of printer. In any event, the invention contemplates advancing along a longitudinally extending path P toward folding means 41 a first series of single sheets 47 each of which has been printed in the printer 40. These sheets, in the illustration given in FIG. 1, may advantageously be equipped with glue as at 42 to provide for the closure of the envelope when each of the series of single sheets constitutes the outgoing envelope of a mailer assembly like that of my above-mentioned patents.

The numeral 43 designates generally a sheet adding station. At this station 43, a second series of additional sheets 48 are added in juxtaposed relation to the series of sheets 47 which have been processed through the printer 40. Thereafter, the forward end of one sheet of one of the series is introduced as at 44 into the folding means 41 and thereafter, one or both series of sheets are folded along a plurality of spaced apart parallel lines.

Figure 2:
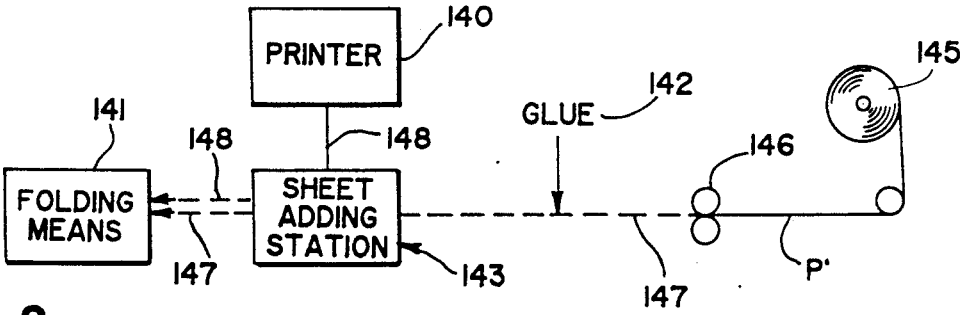
FIG. 2 is another schematic representation of another embodiment of the invention.

A number of different arrangements are possible through the practice of the invention. For example, in FIG. 2, the computer generated sheets are added at the station 143, having come from the printer 140. In FIG. 2, sheets 147 that have not been generated by the printer 140 are provided from a roll 145 or pack to be advanced along the path P' and severed into discrete segments at a cutting station 146. Glue is added to these individual non-computer printed sheets as at 142. The glue pattern could also be applied beforehand using remoistenable, heat or pressure activated glues. After the computer generated sheets 148 are added at station 143, the now superposed sheets are introduced into the folding means 141 at the extreme left of FIG. 2. This embodiment is particularly advantageous where the sheets 147 developed from the roll 145 are to be employed as the outer envelope for the computer generated sheets 148 emanating from the printer 140.

Computer Generated Ply As Outgoing Envelope

In FIG. 1, the computer generated form 47 provides the outer envelope while in FIG. 2, the computer generated form 148 provides the insert—each sheet 147 providing the outer envelope or what I choose to term "exsert". By that I refer to a part or ply other than the computer generated form which forms the outer envelope or ply. Thus, there is no "exsert" in the arrangement of FIG. 1.

Figure 3:
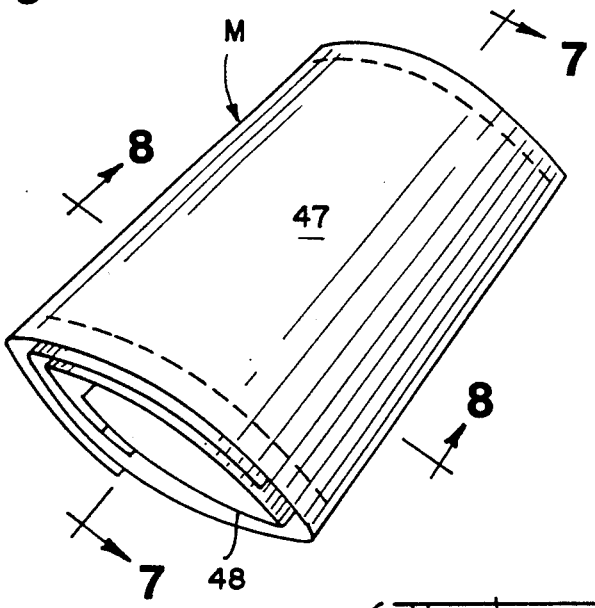
FIG. 3 is a perspective view of one embodiment of folded form produced according to the teaching of the invention.

An embodiment of my invention made according to FIG. 1 is shown in FIG. 3. Here a form 47 of a type shown in my Patents 4,754,915 and 4,754,278 suited for non-impact printers 40 is folded around an addition or insert that has been added in this embodiment after computer printing and during the folding operation. The addition 48 is shown as a conventional return envelope but this could just as well represent an additional ply or pamphlet, coupon, label, specialty envelope or the like.

Figure 7:
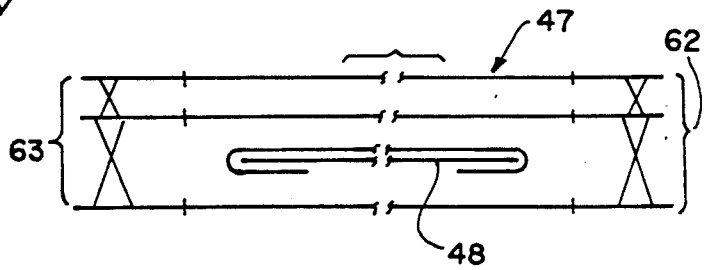
FIGS. 7 and 8 are sectional views such as would be seen, respectively, along the sight lines 7—7 and 8—8 applied to FIG. 3.
Figure 8:
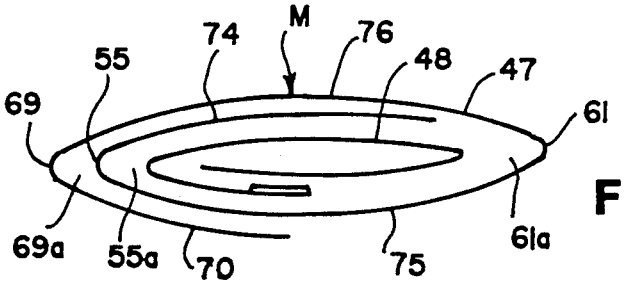
Figure 4:
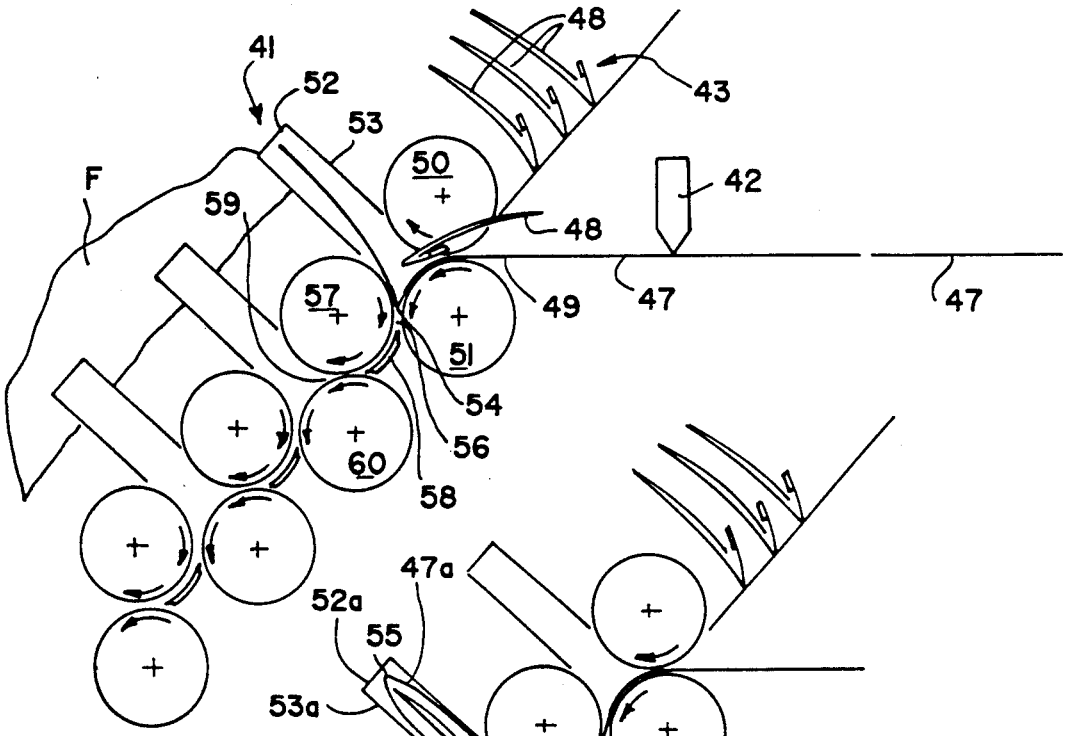
FIG. 4 is a schematic side elevational view of apparatus shown in the practice of developing the first fold of the embodiment of FIG. 3.
Figure 5:
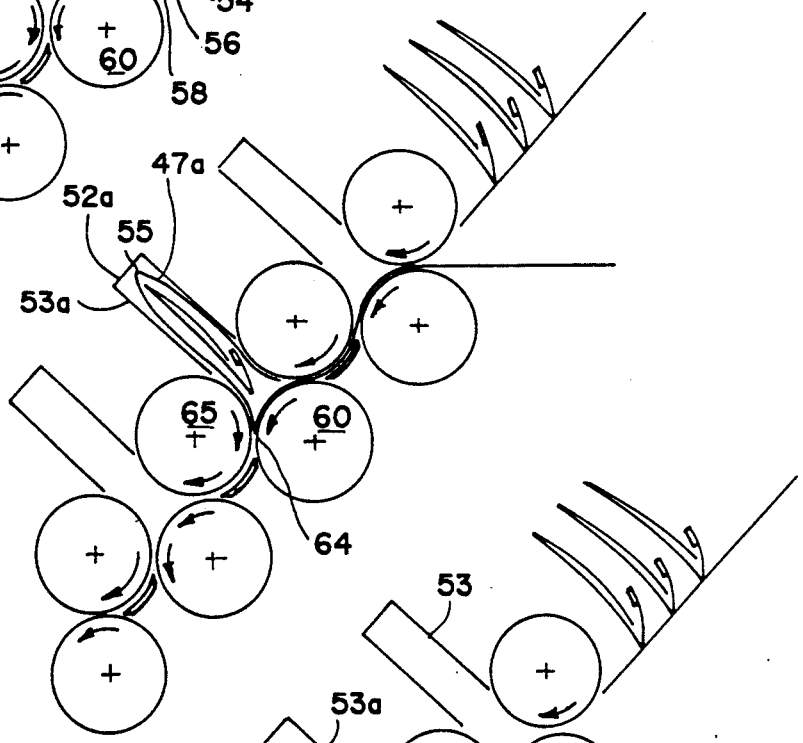
FIGS. 5 and 6 are views similar to FIG. 4 but showing the apparatus in subsequent stages of developing the form of FIG. 3.
Figure 6:
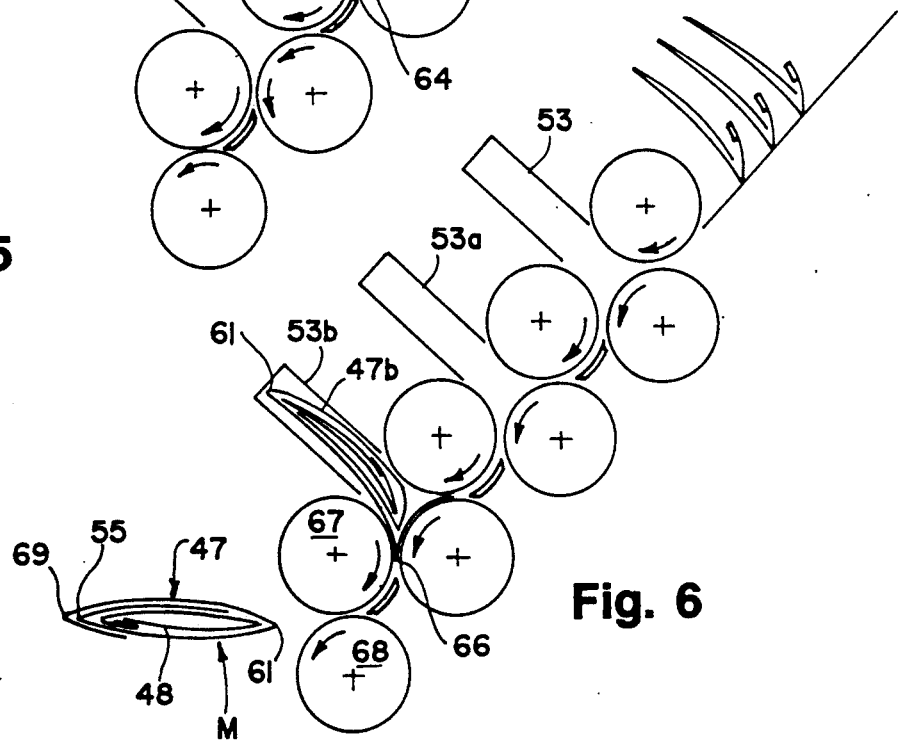

FIGS. 4, 5, and 6 show a sheet folder 41 for producing the embodiment of FIGS. 3, 7 and 8. In FIGS. 4–6, there are three folding plates extending upward of conventional design and usually referred to as "folding plates up". Also shown is a feeder station 43 suited for feeding the addition at the time the computer printed form enters the first nip 49 between first and second folding rolls 50 and 51. The feeding of the addition 48, i.e., the insert in this embodiment, is timed so the insert 48 is placed onto the form 47 in proper registration, i.e., spaced rearwardly of the leading edge of the form 47. A sensor S detects the leading edge of form 47 is shown in FIG. 1. Also shown in FIG. 4 are glue applying nozzles 42 to apply continuous or interrupted lines of glue in the vertical margins (i.e., longitudinal margins) of the form 47 and lines or dot patterns of glue in places across the width if desired and if other glue patterns have not been provided previously.

FIG. 4 shows the form 47 and the envelope addition 48 at a point in time during folding when the leading edge of the form 47 has engaged the stop 52 in the first buckle folder chute 53 and the first buckle 54 is being formed, ultimately becoming the first fold 55 (see FIGS. 5 and 8). The first fold 55 is confirmed by the second nip 56 defined between the second folding roll 51 and the third folding roll 57. Thus, the chute 53 is positioned on the frame F (shown fragmentarily) between the sequential nips 49 and 56. The now once-folded ply (with one end of the insert 48 captured in the fold) is directed by deflector 58 toward a third nip 59 defined by the third folding roll 57 and a fourth folding roll 60—to become the second fold 61 in the same fashion as the first fold 55. All of the folding rolls are rotatably mounted on the frame F. In this case, there is no need to fasten the addition 48 to the form 47 as it is controlled first by the friction of the folding rolls 50, 51 and later it becomes constrained by the folds 55, 61 (see FIG. 8) and the glued margins 62, 63 of the form 47 (see FIG. 7).

FIG. 5 shows the partially folded form 47*a* in the position when the first fold 55 has engaged the stop 52*a* in folding chute 53*a* and the second buckle 64 has formed in preparation for the second fold 61—again see FIG. 8. The second fold 61 is developed by the buckle 64 passing through the fourth nip (provided by the fourth and fifth folding rolls 60, 65).

FIG. 6 shows the third buckle 66 being developed in the twice folded form 47*b*. The buckle 66 is similar to those at 54 and 64 by virtue of the twice folded outer ply entering the chute 53*b*. FIG. 6 also shows the completed mailer M exiting the folder 41 by rollers 67 and 68—the third fold being designated 69, the folded mailer being seen in larger scale in FIG. 8.

FIG. 8 shows the folded mailer 47 of FIG. 3 as it exits from the folder 41 in the preferred orientation for ease of collecting and stacking the completed forms 47 with the addition 48 enclosed. This mailer construction is preferred because the panel forming the envelope flap 70 is positioned downwardly—so the next delivered mailer cannot catch or otherwise be interfered with, compare the FIG. 8 mailer M with the mailer M' with flap 70' of FIG. 12. In terms of folds and construction, the mailer assemblies of FIGS. 3 and 12 are identical.

Figure 9:
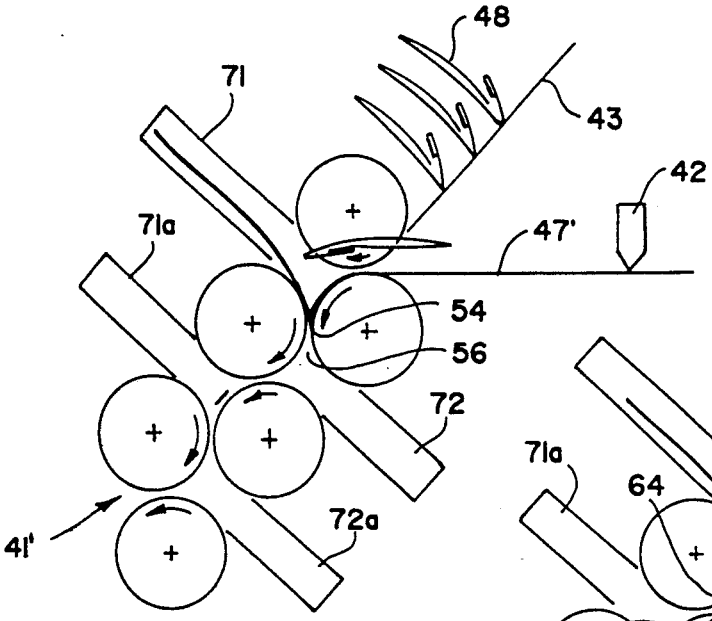
FIG. 9 is a schematic side elevational view of a more commonly available folder which can be used in the practice of the invention.
Figure 10:
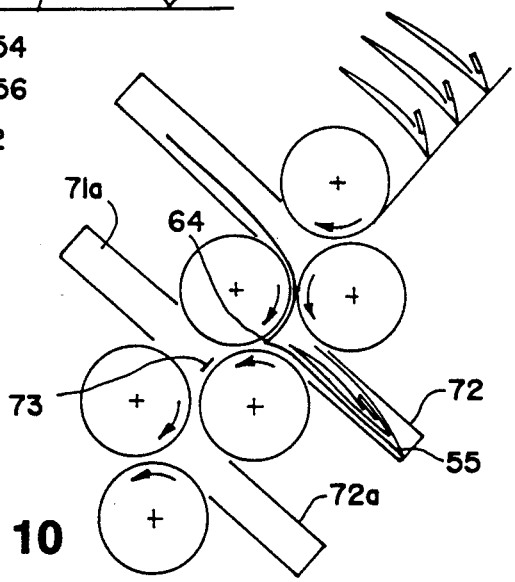
FIGS. 10 and 11 are views similar to FIG. 9 but showing the apparatus in subsequent stages of operation.
Figure 12:
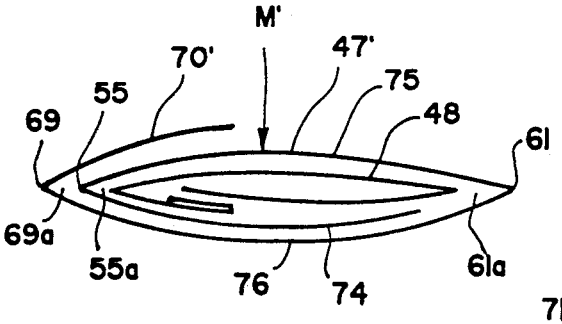
FIG. 12 is a view essentially similar to FIG. 8 but showing the folded form as it issues from the folding equipment of FIG. 11.
Figure 11:
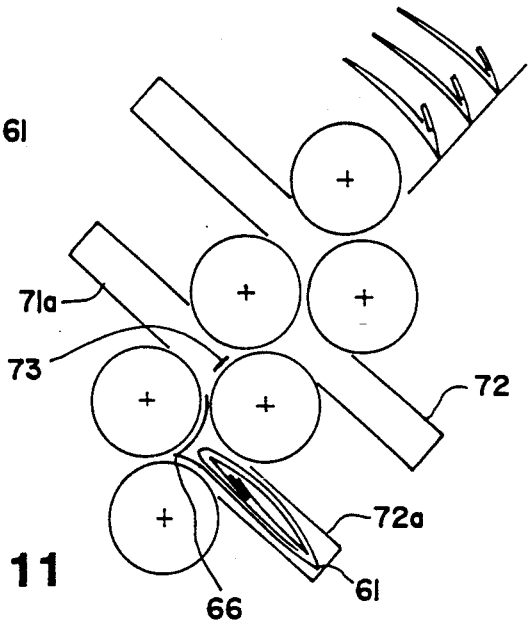

FIGS. 9–11 show a folding sequence for the form of FIG. 12 using the more commonly available folder 41' with two upwardly extending folding chutes 71, 71*a* and two downwardly extending chutes 72, 72*a*. It is well known in practice to use the various combinations of folding chutes extending up and down to achieve desired folds using the many combinations possible.

In this case, the mailer M' (see FIG. 12) exits from the folding equipment 41' in an inverted condition as compared with that of FIG. 8—see also FIG. 6. By inverted, I refer to the fact that the flap 70' in FIG. 12 is facing upwardly whereas the flap 70 of FIG. 8 is facing downwardly. It will be appreciated that when the flap is facing upwardly, a succeeding or following folded form could engage the flap unless the same is overlapped by the following form. There is no such difficulty with the form orientation as seen in FIG. 8.

In FIG. 9, the first buckle 54 is being formed in the second nip 56, as in FIG. 4. The sequence now changes—see FIG. 10. There, the first fold 55 has moved downwardly into the folding chute 72. This creates the second buckle 64 which forms the second fold 61. Inasmuch as this mailer assembly needs only three folds, viz., three chutes as at 53, 53*a* and 53*b* in FIG. 6, I blank off the chute 71*a* by deflector 73—see FIGS. 10 and 11. This directs the twice folded form (as at 55 and 61) into the second bottom chute 72*a* to form the third buckle 66 which results in the third fold 69.

In both instances (FIGS. 8 and 12) there is provided an outer ply 47, 47' which emanates from the computer printer and which is transversely folded three times. The fold 55 defines a pocket 55*a* and the fold 61 defines a pocket 61*a*. The return envelope is received in pocket 55*a* in between the two folds 55 and 61. The fold 69 defines a pocket 69*a* which receives the fold 55, each of the received folds conforming generally to the fold pockets receiving them.

These folds 55, 61 and 69 define four panels 74, 75, 76 and 70 or 70', starting from the inside. The message is printed on the panel 74 with panel 75 providing the back of the outgoing envelope, panel 76 the front with addressee information and 70 or 70' the flap. The return envelope 48 is between the message panel 74 and the panel 75 adjacent thereto. The outer envelope and message-providing ply is advantageously wider than the return envelope permitting side opening by a tear strip.

Although the form 47 can be a continuous series fed into the computer printer as a continuous form from a zig-zag folded pack or from a roll, it can also be fed into the printer as an individual sheet. It is well known in the art to convert a continuous form into a sheet by trimming off the control punch margins and bursting the continuous form across the web perforations or cutting the continuous web into discreet lengths using machines such as the German-made Bowe Cutter well known in the art.

Figure 13:
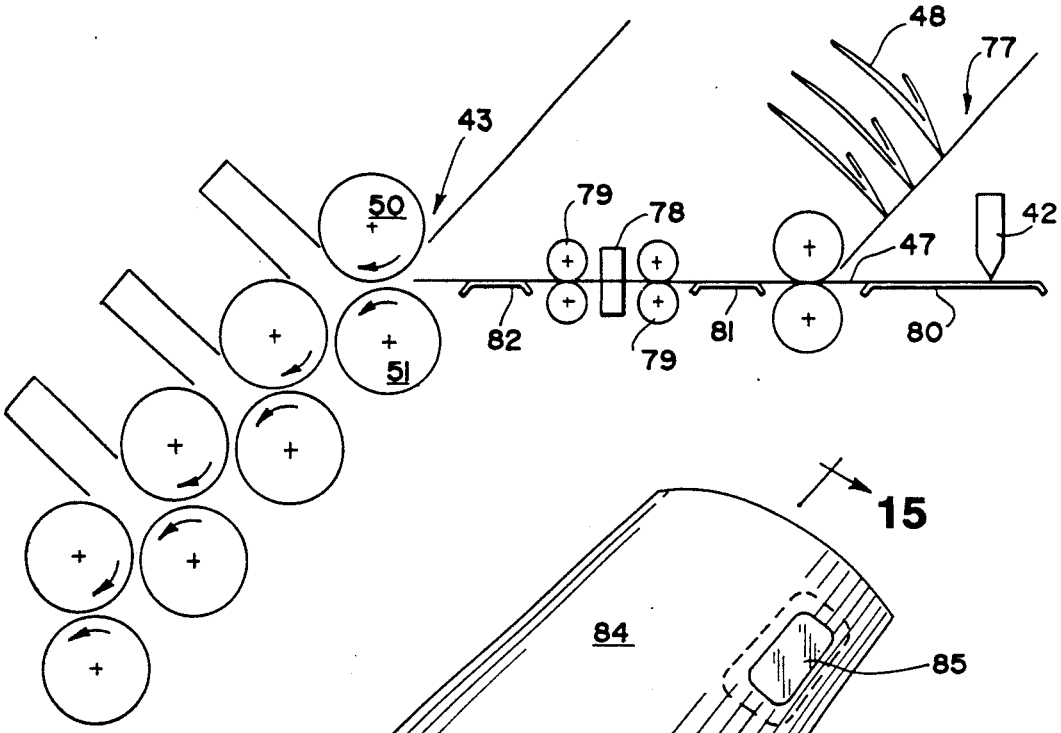
FIG. 13 is a schematic side elevational view of equipment useful in the practice of the invention and which shows the arrangement for utilizing two feeder stations for two added plies.

FIG. 13 shows an alternate method of making the addition 48 to the computer printed form 47. Here the addition 48, shown as before as a return envelope, is added to the form 47 before the form reaches the first folding rolls 50, 51 using feeder station 77.

The addition 48 can be added using feeder station 77 to apply the addition 48 onto the form 47 before it reaches the folding rollers 50, 51. It will be seen later that two additions can be advantageously made using both feeder stations 43 and 77. Also one of the feeder stations can be used to feed the form and the addition can be used as the carrier sheet to become the outgoing envelope. By carrier sheet, I refer to that web, sheet or ply that emanates from the most upstream source, as at 145 in FIG. 2. It is the sheet that "carries" those additions from feeder stations 43 and 77. But the carrier sheet can be the computer generated form or the addition as an insert or an exsert. The feeding of additions or forms from either of the feeder stations provides great versatility in the forms structures that can be assembled by this method.

In making the addition from feeder station 77 as shown in FIG. 13 several methods of controlling the position of the addition 48 on the form can be used to insure that it remains in the desired position during folding.

Often the addition can be fastened easily by applying lines or spots of glue using the glue nozzles shown at 42. Other methods that are used are crimping, stapling and static electricity as at station 78.

Another method of controlling the position of the addition 48 without fastening is shown in FIG. 13. Here a series of pairs of friction rollers 79 spaced apart a distance less than the length of the addition keep the addition moving toward the folding rolls at the same speed as the carrier sheet without an actual fastening of the separate parts. Supporting tables 80, 81 and 82 support the carrier sheet on its way to the folding rolls 50, 51. Other conveyor rollers (not shown) are employed to advance the carrier sheet 47.

Computer Generated Ply As An Insert

The added material need not be placed inside the form as shown in FIGS. 3–13. The addition can also be folded outside and around the computer generated form to provide an exsert. In this case, the exsert serves as the outgoing envelope and the computer printed form is an insert. The advantage of this arrangement is that the entire surface of the computer printed form can be used for variable information and still be retained confidentially inside the outgoing envelope during mailing. In this way, all of the advantages of a simple form during the computer printing described earlier are retained but the percentage of the area of the form available for confidential message information is increased by several times.

Figure 14:
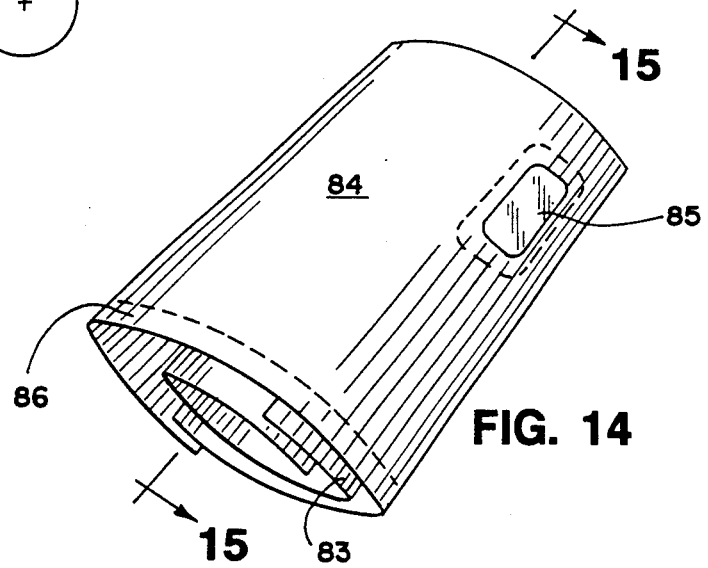
FIG. 14 is a perspective view of a structure according to the invention featuring an added plies that serves as the outgoing envelope and which is equipped with a window.

FIG. 14 shows the computer printed form as the inside additional insert 83 and a carrier sheet 84 which is an exsert including a window 85 to serve as the outgoing envelope, i.e., the exsert. Notice that the outside envelope can be made wider than the inside ply 83 so that only one end tear off strip 86 is needed to open the mailer and remove the insert (see FIG. 14 and the left hand portion of FIG. 15). This tear off strip 86 can include only the folded plies of the outer envelope for easier removal by the recipient or it may be used to fasten the inner and outer envelope during folding as seen in FIG. 16 at 86'. In this case, the inner ply 83 is freed of the outer envelope when the one tear off strip 86' is removed by the recipient of the mail.

The window 85 is used in the conventional manner to expose the "to" name and address while other confidential information is concealed.

Figure 17:
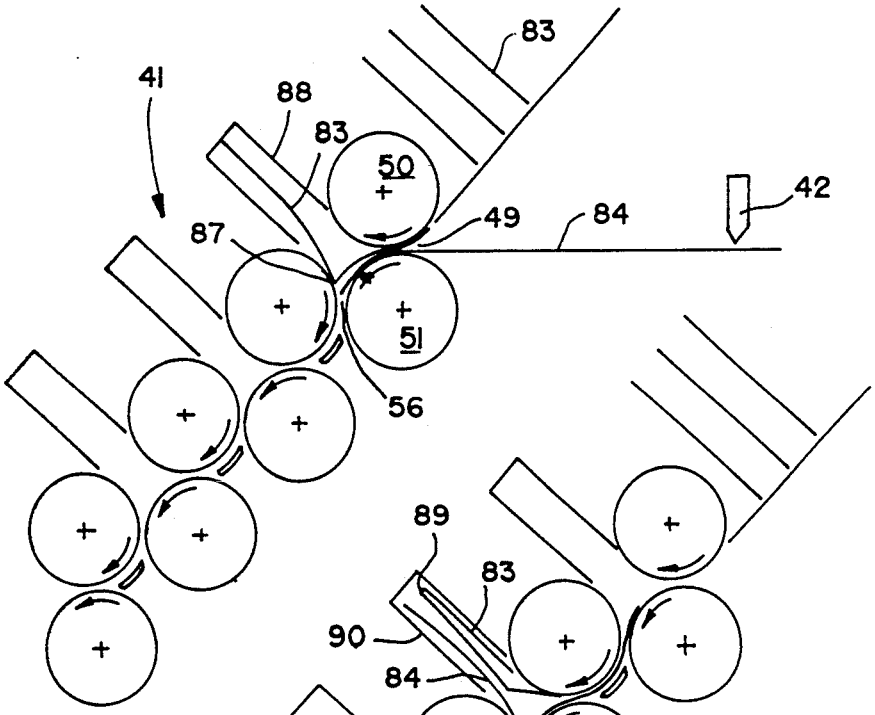
FIG. 17 is a schematic side elevational view of folding apparatus employed in the manufacture of the structure of FIG. 14.
Figure 18:
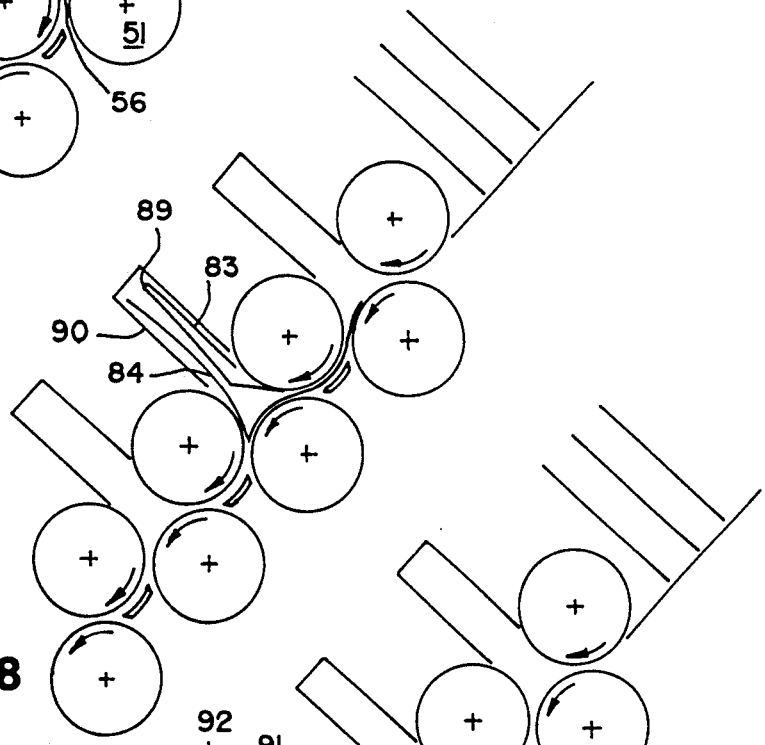
FIGS. 18 and 19 are views similar to FIG. 17 but of subsequent stages in the folding operation.
Figure 19:
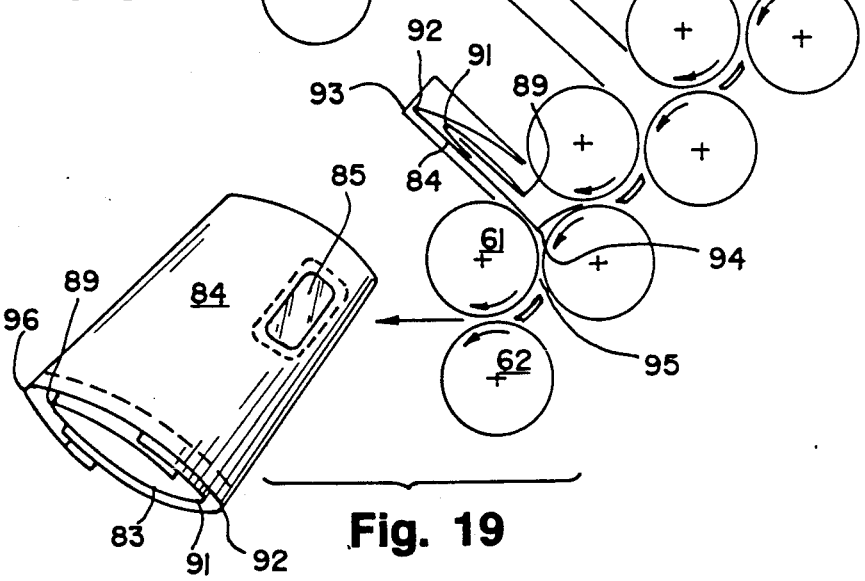

FIGS. 17–19 show the folding sequences for the form of FIG. 14 in a way generally similar to that of FIGS. 4–6. A difference, however, resides in the fact that each ply is folded only twice. Referring to FIG. 17, it is seen that the computer generated ply 83 is buckled at 87 by virtue of having entering the first chute 88. The exert ply 84 by-passes the chute 88 and along with the once folded ply 83 (folded as at 89 in FIG. 18) enters the second chute 90. Then, the twice-folded insert ply 83 (as at 89 and 91) and the once-folded exsert ply 84 (as at 92) enter the third chute 93—see FIG. 19. This causes the buckle 94 to develop and, by virtue of the nip 95, develops the second fold 96 in the exsert 84. As in the embodiments of FIGS. 8 and 12, in the FIG. 14 construction each fold of the insert is received within a fold pocket of the outer ply and conforms generally thereto.

The construction of FIGS. 17–19 illustrate a different timed addition—where the insert enters the nip between rolls 50, 51 first—see FIG. 17. This is in contrast to the arrangement of FIG. 4 where the outer ply 47 is the first to enter the nip 49.

Mailer With Two Inserts

Figure 20:
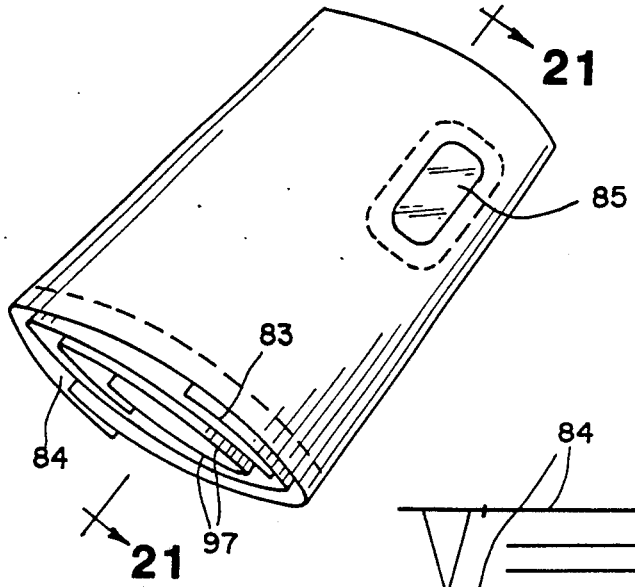
FIG. 20 is a perspective view featuring both an outer added ply and an inner added ply.

FIG. 20 shows the structure of FIG. 14 with a second addition 97. This second addition 97 is positioned inside the first addition 83 to provide, for example, a return envelope. The second addition or even further additions could be used for any of the applications earlier suggested.

Figure 22:
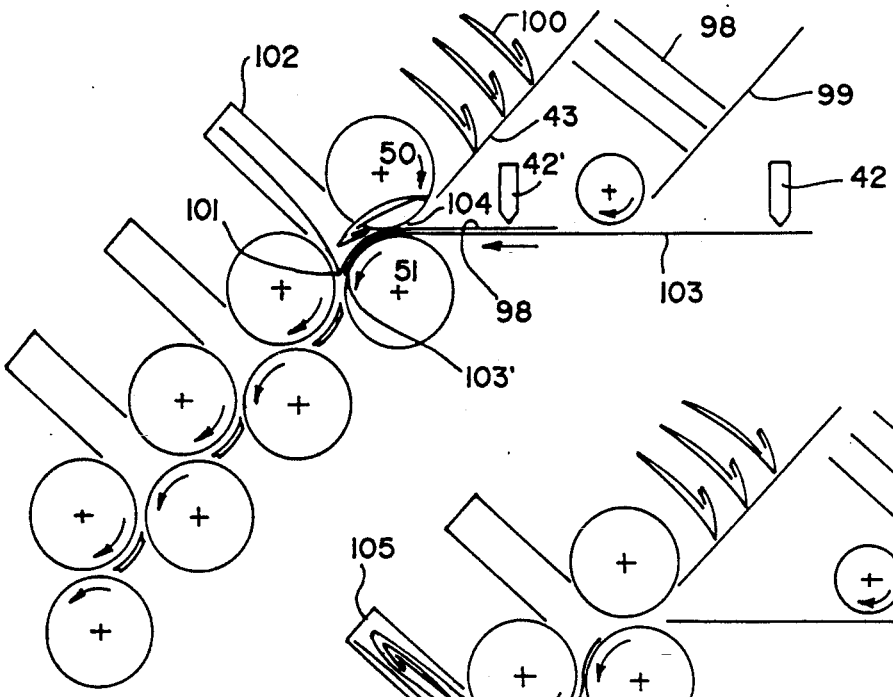
FIG. 22 is a schematic side elevational view of folding equipment employed in the production of the structure of FIG. 20.
Figure 23:
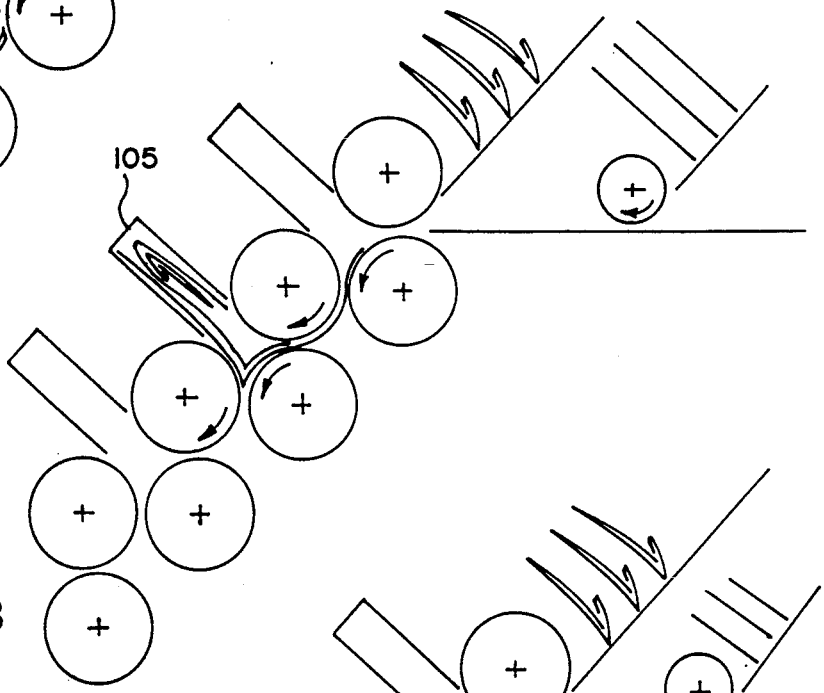
FIGS. 23 and 24 are views similar to FIG. 22 but of the folding equipment in subsequent stages of operation.
Figure 24:
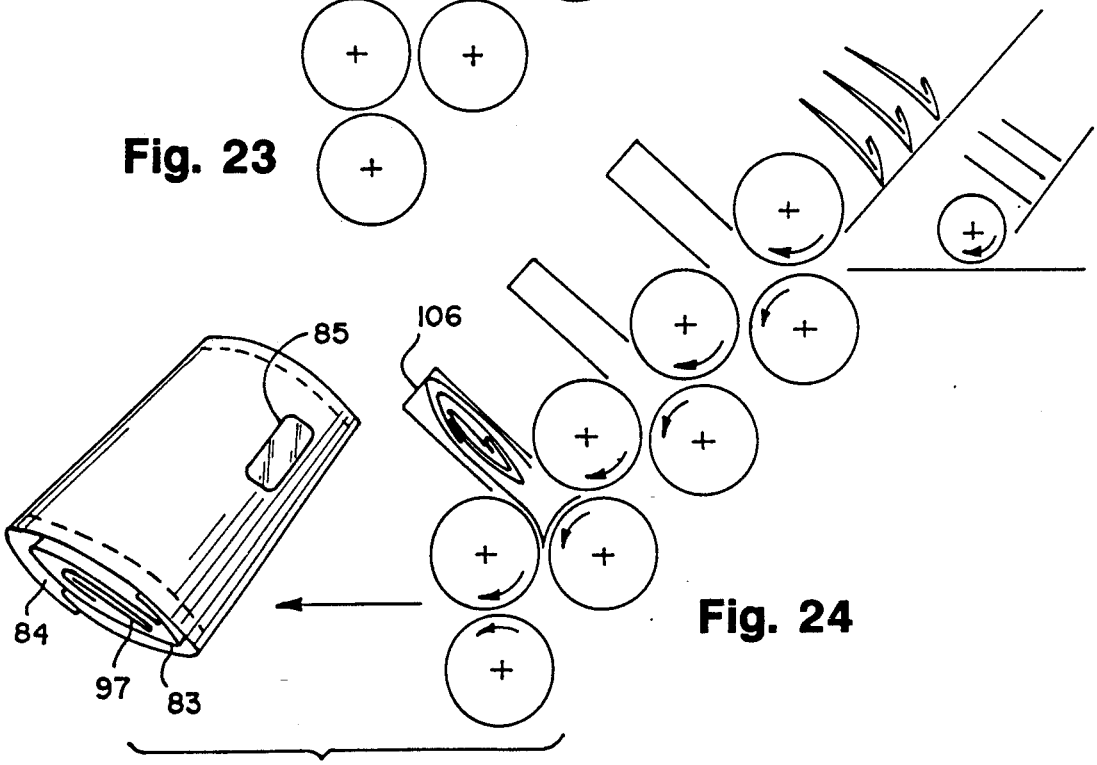

FIGS. 22–24 show the method used to fold the two additions of FIG. 20 into a form ready for mailing. For example, the numeral 98 designates in this instance a computer generated form which is fed from the station 99 first into the nip between the rolls 50, 51. Addition 100 which, in this instance, is shown as a return envelope, is fed from the station 43 such that it overlies a portion of the already introduced computer generated form 98 (ultimately being positioned within the buckle 101 developed by the upper chute 102). At about the same time as the introduction of addition 100, exsert 103 (which will become the outgoing envelope) is introduced into the nip 104 between the rolls 50 and 51 as shown in FIG. 22. The leading edge of the exsert 103 is shown at 103' and is closely adjacent to the folds in the additions 98 and 100. The introduction of the three elements, viz., the addition 98, the addition 100 and the exsert 103 into the nip 104 between the rolls 50, 51 in timed relation establishes the relationship between these various elements for the remainder of the folding operation, viz, the leading edge of the addition 98 enters the nip 104 first and provides the ply material for the buckle 101 with the leading edges of the addition 100 and exsert 103 being rearward and closely adjacent the buckle 101—so that here the computer generated addition overlaps or protrudes further than the other plies.

FIG. 23 shows the relationship of these parts as the second buckle is being developed in the chute 105. Similarily, the showing in FIG. 24 is of the third buckle that is developed in these parts as in the chute 106. The orientation of the parts in the folded assembly can be appreciated from the perspective showing at the extreme left hand portion of FIG. 24 and which is shown in larger scale in FIG. 20.

In all of the constructions shown so far the method of opening the mailer has been by removal of one or two end tear off strips at the edge of the outgoing envelope.

Figure 15:
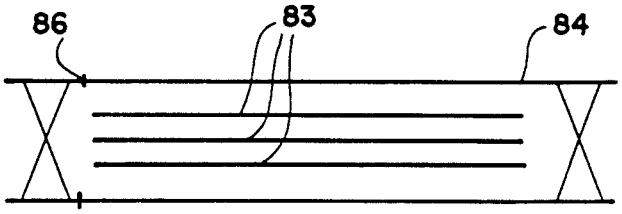
FIG. 15 is a sectional view taken along the sight line 15—15 of FIG. 14.
Figure 16:
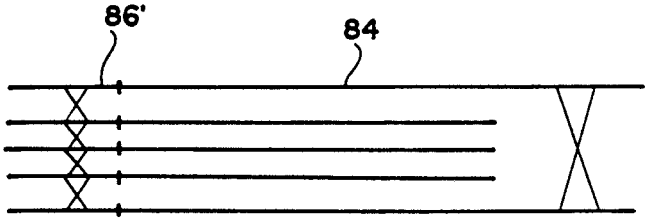
FIG. 16 is a view similar to FIG. 15 but of a modified version of the construction of FIG. 14.
Figure 21:
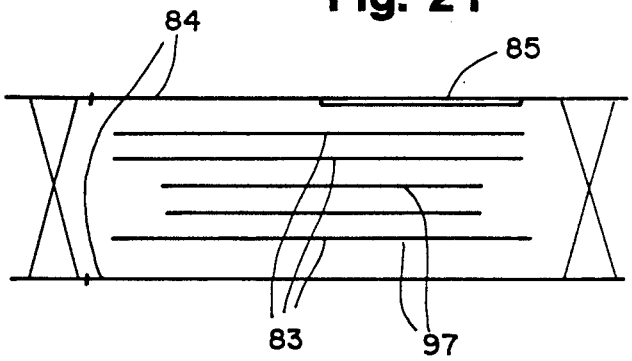
FIG. 21 is a sectional view taken along the sight line 21—21 of FIG. 20.
Figure 25:
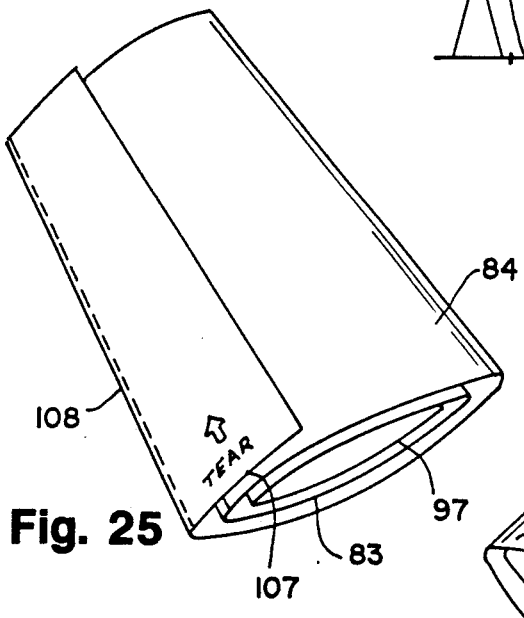
FIG. 25 is a perspective view of yet another embodiment of the invention featuring a tear-off strip for easy opening.

FIG. 25 shows a mailer similar to that of FIGS. 14, 15 and 20, 21 except that it is provided with a zip opening device 107 rather than the side tear off strip 86 of FIG. 15. In this case the flap can be provided with a perforation 108 preferably at the flap fold. The inside plies 83, 97 are narrower than the outer ply 84 as shown in FIG. 21. The recipient is instructed to grasp one end of the tear off strip 107 and tear it across at the perforation 108. This method of opening results in an outer envelope that is easy for the recipient to reinsert the form (and return envelope of FIGS. 14 and 20 or other contents) for attention at a later time after the initial opening of the mail.

The flap can be held with only glue lines at each end in the tear off strips as shown in FIGS. 15 and 16. The flap may also have a glue line or a series of spots across the width to further adhere the flap in the closed position.

A third method of opening the structures of FIGS. 14 and 20 is by use of a common letter knife. In this case, it may be desirable to provide a weakening perforation 108 at the flap fold. The electric letter openers found in most mail rooms can also be used to trim off the flap fold to open the envelope.

Windowless Modification of FIG. 14 Mailer

Figure 26:
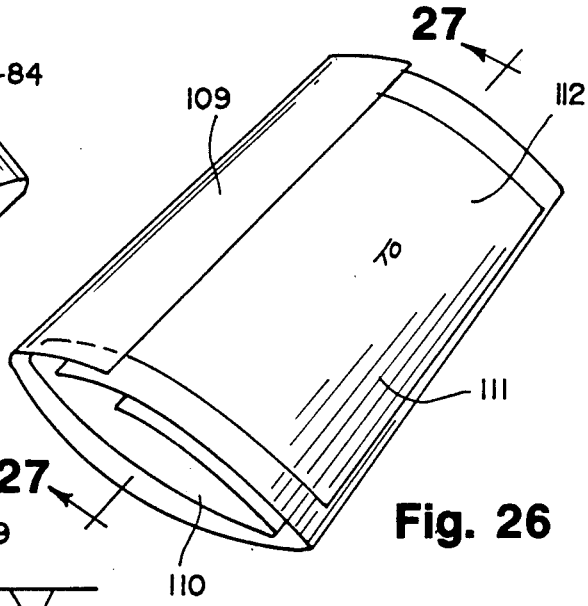
FIG. 26 is a perspective view of another embodiment made according to the teachings of the invention and which features an outer added ply without a window.
Figure 27:
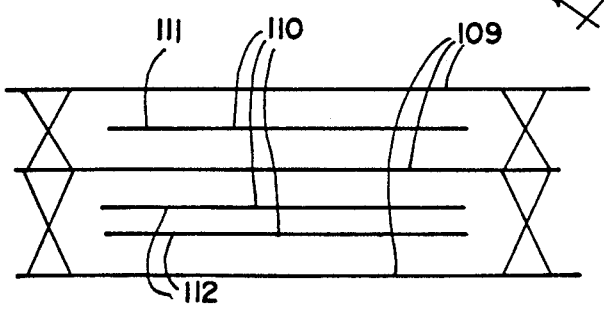
FIG. 27 is a sectional view taken along the sight line 27—27 of FIG. 26.
Figure 28:
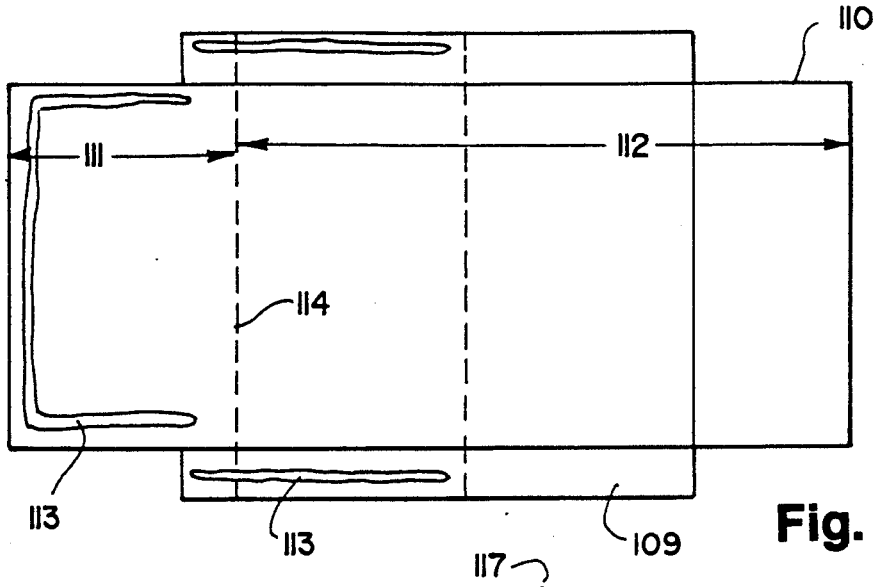
FIG. 28 is a plan view of the unfolded sheets employed in developing the construction of FIG. 26.

The outer addition that serves as an outgoing envelope need not have a window as at 85 in FIG. 14. FIGS. 26–28 show a structure where the outer addition 109 is folded around the computer printed form 110 to expose only a minor portion 111 of form 110. The minor exposed portion 111 carries the computer generated address information 112 and can be torn off upon opening the mailer and discarded leaving the major portion 112 of the message ply that was enclosed by the outer addition 109 (see FIG. 28). It is recognized that the structure shown in FIG. 26 could be used with a second addition as shown in FIGS. 20–24.

As seen in FIG. 28, the construction of FIG. 26 has all of the glue pattern 113 required on the upper surfaces of the form 110 and the outer addition 109 so only one glue station is required. This station is most conveniently located between stations 99 and 43 as at 42' (see FIG. 22) to apply the glue pattern after the addition is joined with the form but before folding.

A perforation 114 can be provided in form 110 and outer addition 109 to facilitate opening the envelope. However, the construction can be opened using a conventional letter opener or letter opening machines typically found in mail rooms. When the envelope is opened by either of these means the exposed minor portion of the mailer is separated from the major portion so the recipient has nothing further to do but to remove the message portion and other additional inserts if these have been included also.

Mailer With Return Envelope Attached To Exsert

Figure 29:
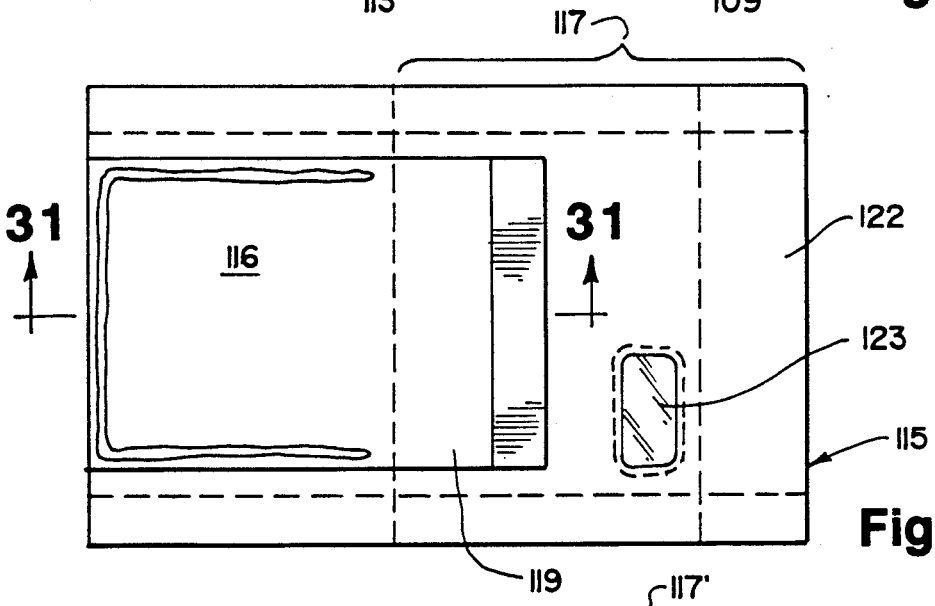
FIG. 29 is a plan view of an outer added ply serving both as an outgoing and return envelope.
Figure 30:
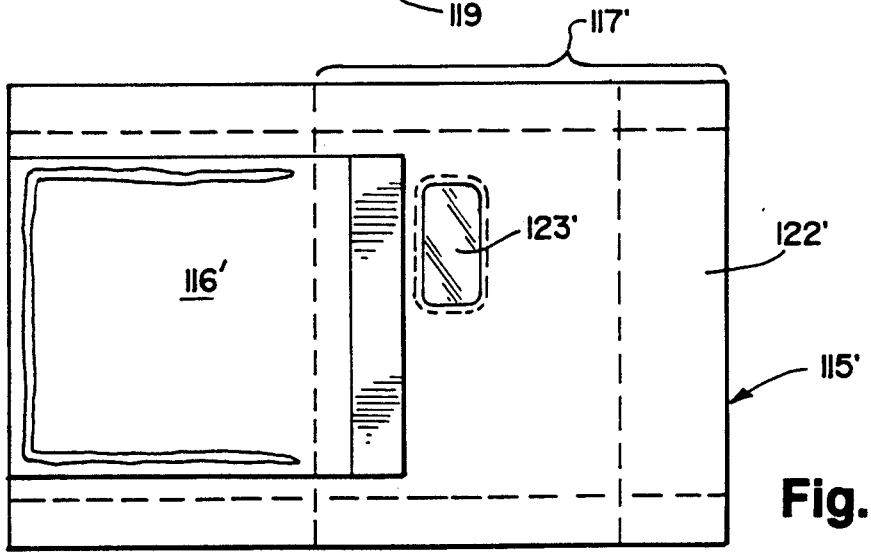
FIG. 30 is a view similar to FIG. 29 but of a modified version thereof.
Figure 31:
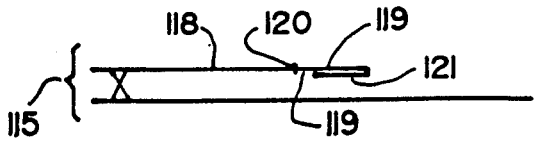
FIG. 31 is a sectional view taken along the sight line 31—31 of FIG. 29.

In another embodiment as seen in FIGS. 29–31, the exsert or outer addition generally designated 115, 115' is used to provide an outgoing envelope for the computer generated form. This, as shown in FIGS. 29–31, includes a return envelope 116, 11640 using a portion of the exsert 115 or 115' as part of the front or the back of the return envelope. The balance 117 or 117' of the exsert 115 or 115' is to be thrown away by the recipient.

An additional piece 118 (see FIG. 31) is shown glued to the outer addition 115 to form the face of the return envelope. This additional piece 118 could be added in one version as a separate manufacturing operation so the outer addition 115 already has the piece 118 attached before being added in the folding operation. Alternatively, the additional piece 118 could be added as one of the additions using the glue pattern applied by the glue nozzles or other gluing devices on the first addition.

As seen in FIG. 31, the additional piece 118 may have a flap portion 119 defined by a line of weakness or folding 120 and equipped with a band of flap sealing adhesive 121. This is also applicable to the version of FIG. 30.

The construction of FIG. 29 differs from that of FIG. 30 in that, when folded, the flap 122 of the outgoing envelope of FIG. 29 will be at the bottom of the outgoing envelope while the flap 122' of FIG. 30, when folded, will be at the top of the outgoing envelope—see the position of windows 123, 123'.

Although the larger flap 119 on the return envelope 116 of FIG. 29 is desirable, it is done at the disadvantage of a less conventional looking outgoing envelope—i.e., one that results when the flap 122 is at the bottom as in the outgoing envelope of FIG. 29.

SUMMARY OF OPERATION

A series of computer generated plies 47 (see FIG. 1) are advanced along a path P past a station 43 which adds to each ply 47 a second or insert ply 48 (a return envelope, coupon, etc.) which is superposed (see the left hand portion of FIG. 1) and introduced into the first nip 49 of first folding rolls 49, 50 during the feeding of sheet 47 (see FIG. 4). In either event, the ply 47 (the computer generated ply which serves as the carrier and is folded around the insert) has a forward portion extending forwardly of the insert to first develop a buckle 54 (see FIG. 4) which becomes a fold 55 after passing through the second nip 56.

However, the function of the plies may be reversed. In FIG. 17, for example, the insert 83 is the computer generated ply, viz., the insert, and the carrier ply 84 is an "exsert". Although, in FIG. 17, the insert 83 precedes the carrier 84 on entering the first nip 49 and develops a buckle in the second nip 56, the carrier 84 is folded around the insert—see FIGS. 18 and 19.

So, one of the plies in the two or more series of plies precedes the other(s) to have a buckle developed therein. I provide means S for detecting the leading edge of the carrier sheet 47 (see FIG. 1). This also senses the speed of the sheet 47 and uses this information to provide a properly registered pattern on the sheet 47. Further, the sensing means S also uses this information to start feeding additions in a predetermined registration with the carrier sheets.

Once the buckle is formed and the first fold confirmed, the superposed sheets are subjected to further buckle forming. For example, where the computer generated sheet or ply 83 (FIGS. 14–19) is the insert, this is folded first once on itself (as at 89 in FIG. 18). Thereafter, it is folded simultaneously with the carrier sheet or exsert 84 (FIGS. 18–19). And, lastly, the carrier sheet is folded again—buckle 94 becoming fold 96—see FIG. 19. So, at least two folds are provided in the outer sheet which becomes the outgoing envelope of the mailer.

Where the computer generated sheet provides the outgoing envelope, three transverse folds are developed as at 55, 61 and 69—see especially FIGS. 4–6. This advantageously encloses a previously folded item (like the return envelope 48), coupon, pamphlet, etc. If folding of the insert is indicated, the procedure of FIGS. 18–19 can be used.

I claim:

1. A mailer assembly comprising a rectangular outer ply having longitudinally extending free, generally straight sides and free, generally straight transverse ends, said outer ply having two transverse folds intermediate said ends to provide a pair of fold pockets, and an insert ply having longitudinal extending sides and straight transverse ends and positioned in said fold pockets and extending therebetween, said insert ply being relatively elongated and being equipped with computer generated information and also being equipped with a pair of transverse folds intermediate said insert ply ends, said insert ply folds being positioned within the fold pockets of said outer ply and conforming generally thereto, said outer ply two transverse folds defining an intermediate panel therebetween, said panel being equipped with window means, said insert ply being equipped with addressee information aligned with said window means, said insert ply two transverse folds defining end panels, said end panels being in contacting relation, one of said insert ply end panels being in contact relation with said outer ply intermediate panel, said outer ply intermediate panel being flanked by a pair of end panels, one of said outer ply end panels being in contacting relation with said insert ply the other of said outer ply end panels constituting a closure flap and being in contacting relation with said one outer ply end panel, said outer ply having inner and outer faces with the inner face being equipped with adhesive along the outer ply longitudinally extending sides.

2. The assembly of claim 1 in which a return envelope is positioned within said insert ply.

3. The assembly of claim 1 in which said insert ply is narrower than said outer ply, said outer ply being equipped with a tear off strip.

4. The assembly of claim 3 in which said tear off strip is defined by a longitudinally-extending line of perforation adjacent one of said outer ply longitudinally-extending sides and including said adhesive.

5. The assembly of claim 3 in which said tear off strip is defined by a transversely-extending line of perforation adjacent a fold in said outer ply.

6. The assembly of claim 1 in which said insert ply is narrower than said outer ply, said outer ply being equipped with a longitudinally-extending line of perforation adjacent one of longitudinally extending sides to provide a tear off strip including said adhesive.

7. A mailer assembly comprising a rectangular outer ply to provide a pair of sides and a pair of ends and having two transverse folds intermediate the ends of said ply to provide a pair of fold pockets, and an insert ply positioned in said fold pockets and extending therebetween, one of said plies being a computer generated form, said insert ply being relatively elongated to provide a pair of ends and providing said computer generated form and being equipped with a pair of transverse folds intermediate the ends of said insert ply, said insert ply folds within the fold pockets of said outer ply and conforming generally thereto, said plies each having a pair of fold lines developing said folds and providing inner, intermediate and outer panels arranged in confronting relation, the outer panel of said ply to provide an overlapping flap, and addressee information on said flap.

8. The assembly of claim 7 in which said insert ply is narrower than said outer ply.

9. The assembly of claim 8 in which said outer ply overlaps said insert ply along both longitudinal edges, and adhesive means securing said longitudinal edges together.

10. The assembly of claim 7 in which said insert ply overlapping flap is secured to said outer ply.

* * * * *